US008723431B2

(12) United States Patent
Deppe et al.

(10) Patent No.: US 8,723,431 B2
(45) Date of Patent: May 13, 2014

(54) BLEEDER CIRCUIT

(75) Inventors: Carsten Deppe, Aachen (DE); Georg Sauerländer, Aachen (DE)

(73) Assignee: Koninklijke Philips N.V., Eindhoven, IL (US)

( * ) Notice: Subject to any disclaimer, the term of this patent is extended or adjusted under 35 U.S.C. 154(b) by 198 days.

(21) Appl. No.: 13/386,700

(22) PCT Filed: Jul. 27, 2010

(86) PCT No.: PCT/IB2010/053393

§ 371 (c)(1), (2), (4) Date: Jan. 24, 2012

(87) PCT Pub. No.: WO2011/013060

PCT Pub. Date: Feb. 3, 2011

(65) Prior Publication Data

US 2012/0126714 A1 May 24, 2012

(30) Foreign Application Priority Data

Jul. 27, 2009 (EP) ..... 09166448

(51) Int. Cl.
*H05B 37/00* (2006.01)

(52) U.S. Cl.
USPC ..... 315/185 R; 315/291

(58) Field of Classification Search
USPC ..... 315/185 R, 192, 291, 294, 297
See application file for complete search history.

(56) References Cited

U.S. PATENT DOCUMENTS

| | | | | |
|---|---|---|---|---|
| 6,762,563 | B2 * | 7/2004 | St-Germain et al. | 315/129 |
| 2006/0192502 | A1 | 8/2006 | Brown et al. | |
| 2007/0182338 | A1 | 8/2007 | Shteynberg et al. | |
| 2007/0182347 | A1 * | 8/2007 | Shteynberg et al. | 315/312 |
| 2007/0267984 | A1 * | 11/2007 | Peng | 315/312 |
| 2008/0203934 | A1 | 8/2008 | Van Meurs | |
| 2010/0308739 | A1 * | 12/2010 | Shteynberg et al. | 315/193 |

FOREIGN PATENT DOCUMENTS

| | | | |
|---|---|---|---|
| WO | 9956504 | A1 | 11/1999 |
| WO | 2004075606 | A1 | 9/2004 |
| WO | 2005115058 | A1 | 12/2005 |
| WO | 2008029108 | A1 | 3/2008 |
| WO | 2009014418 | A1 | 1/2009 |
| WO | 2010011971 | A1 | 1/2010 |

* cited by examiner

*Primary Examiner* — Jason M Crawford

(57) ABSTRACT

Bleeder circuits (1) for combinations of phase cutting dimmers (2) and light emitting diode circuits (3) comprise active circuitry (4) to increase a number of options. The active circuitry (4) may comprise a current limiting circuit (5) for limiting a current flowing through the bleeder circuit (1). The active circuitry (4) may comprise a voltage detecting circuit (6) for activating or deactivating, in response to a detection result, the current limiting circuit (5) and may comprise control circuitry such as a micro processor circuit (7) for controlling the current limiting circuit (5) and may comprise a control circuit (9) for using information derived from a current flowing through the light emitting diode circuit (3) for controlling the current limiting circuit (5) and for controlling at least a part of the light emitting diode circuit (3) that comprises anti-parallel light emitting diodes (31-32) or serial and/or parallel light emitting diodes (33-36).

15 Claims, 4 Drawing Sheets

BLEEDER CIRCUIT

FIELD OF THE INVENTION

The invention relates to a bleeder circuit for a combination of a phase cutting dimmer and a light emitting diode circuit. The invention also relates to a light emitting diode circuit comprising such a bleeder circuit, to a phase cutting dimmer comprising such a bleeder circuit, and to a device comprising such a bleeder circuit and further comprising a light emitting diode circuit and/or a phase cutting dimmer and/or a stabilization load for a phase cutting dimmer. Examples of such a light emitting diode circuit are circuits comprising one or more light emitting diodes of whatever kind Examples of such a device are lamps, dimmers and stabilization loads.

BACKGROUND OF THE INVENTION

Prior art bleeder circuits improve a performance of a phase cutting dimmer while dimming a light emitting diode circuit by coupling a passive element such as a resistor in parallel to the light emitting diode circuit. Such a passive element offers relatively few options.

US 2007/0182338 A1 discloses a current regulator for modulating brightness levels of solid state lighting.

SUMMARY OF THE INVENTION

Objects of the invention are to provide an improved bleeder circuit for a combination of a phase cutting dimmer and a light emitting diode circuit, which bleeder circuit offers relatively many options, to provide an improved light emitting diode circuit comprising such a bleeder circuit, to provide an improved phase cutting dimmer comprising such a bleeder circuit, and to provide an improved device comprising such a bleeder circuit and further comprising a light emitting diode circuit and/or a phase cutting dimmer and/or a stabilization load for a phase cutting dimmer.

According to a first aspect of the invention, a bleeder circuit is provided for a combination of a phase cutting dimmer and a light emitting diode circuit, the bleeder circuit comprising active circuitry, the active circuitry comprising a current limiting circuit for limiting a current flowing through the bleeder circuit, the active circuitry further comprising a control circuit for using information derived from a current flowing through the light emitting diode circuit for controlling the current limiting circuit.

By having used active circuitry in the bleeder circuit, the bleeder circuit can offer relatively many options.

A bleeder circuit is required in general owing to the fact that a light emitting diode circuit has a minimum threshold voltage value and that, as long as a voltage having a smaller voltage value is supplied, the light emitting diode circuit will not draw current. At the same time, a phase cutting dimmer however requires a minimum current to be able to operate, such as to operate in a stable manner and detect a phase and/or a zero crossing of an input voltage. Additionally some types of dimmers need a minimum current even in an off mode, while the voltage on the lamp is close to zero.

The current limiting circuit allows the current flowing through the bleeder circuit to be limited to a reduced value. The reduced value may be selected by hand for a particular phase cutting dimmer, or may be selected automatically in response to the detection of a particular situation, to reduce the power consumption of the bleeder circuit. This is important nowadays and constitutes a great advantage.

The information derived from the current flowing through the light emitting diode circuit may be used advantageously for controlling the current limiting circuit.

According to an embodiment, the bleeder circuit is defined by the control circuit being connected to an input and an output of the current limiting circuit.

According to an embodiment, the bleeder circuit is defined by the current limiting circuit comprising a parallel connection of first and second serial connections, the first serial connection comprising a first resistor and a voltage reference element, the second serial connection comprising a second resistor and a transistor, a control electrode of the transistor being connected to an interconnection between the first resistor and the voltage reference element, the interconnection being the input of the current limiting circuit, a further interconnection between the second resistor and the transistor being the output of the current limiting circuit. This is a simple and low cost embodiment that is easy to realize. The voltage reference element may be a zener diode, and the transistor may be any kind of transistor.

According to an embodiment, the bleeder circuit is defined by the active circuitry further comprising a voltage detecting circuit for activating or deactivating the current limiting circuit in response to a detection result. The voltage detecting circuit detects a voltage value of a voltage supplied to the bleeder circuit and/or the light emitting diode circuit and activates or deactivates the current limiting circuit in dependence on this voltage value. The light emitting diode circuit only draws current for voltage values of the voltage supplied to the light emitting diode circuit that are higher than a threshold value. So, the bleeder circuit only needs to introduce an additional current until this threshold value has been reached. This way, the power consumption of the bleeder circuit is further reduced, which is nowadays important and constitutes a great advantage.

According to an embodiment, the bleeder circuit is defined by the voltage detecting circuit comprising a third serial connection of third and fourth resistors and comprising a further transistor, a control electrode of the further transistor being connected to an interconnection between the third and fourth resistors, and a main electrode of the further transistor being connected to an input of the current limiting circuit. This is a simple and low cost embodiment that is easy to realize. The further transistor may be any kind of transistor. The input is for example the interconnection between the first resistor and the voltage reference element.

According to an embodiment, the bleeder circuit is defined by the active circuitry further comprising control circuitry such as a micro processor circuit for controlling the current limiting circuit. The control circuitry such as the micro processor circuit is a more advanced version of the voltage detecting circuit and may offer more options.

According to an embodiment, the bleeder circuit is defined by the information derived from the current flowing through the light emitting diode circuit, comprising the magnitude of this current and/or a starting or finishing point in time of this current, said controlling of the current limiting circuit comprising an adaptation of a reduced value of the current flowing through the bleeder circuit and/or an activation or deactivation of the current limiting circuit and/or the active circuitry. Information derived from the current flowing through the light emitting diode circuit, such as for example the magnitude of this current and/or a starting or finishing point in time of this current, may be used advantageously for controlling the current limiting circuit, such as for example an adaptation of the reduced value of the current flowing through the bleeder circuit and/or an activation or deactivation of the current limiting circuit and/or the circuitry.

According to an embodiment, the bleeder circuit is defined by the light emitting diode circuit comprising anti-parallel light emitting diodes, the bleeder circuit further comprising a rectifier for converting a first voltage into a second voltage, the first voltage being an AC voltage for feeding the light emitting diode circuit, and the second voltage being a DC voltage for feeding the active circuitry. The rectifier may comprise one diode or two diodes or four diodes in a diode bridge. Anti-parallel light emitting diodes may comprise one or more pairs of anti-parallel light emitting diodes and may comprise two or more anti-parallel strings of light emitting diodes and may comprise other anti-parallel combinations of light emitting diodes.

According to an embodiment, the bleeder circuit is defined by the light emitting diode circuit comprising serial and/or parallel light emitting diodes, the bleeder circuit further comprising a rectifier for converting a first voltage into a second voltage, the first voltage being an AC voltage, and the second voltage being a DC voltage for feeding the light emitting diode circuit and the active circuitry. This is an efficient embodiment owing to the fact that the rectifier has a double function and is used for feeding both the light emitting diode circuit and the active circuitry. Serial and/or parallel light emitting diodes may comprise serial light emitting diodes and may comprise parallel light emitting diodes and may comprise other serial and/or parallel combinations of light emitting diodes.

According to an embodiment, the bleeder circuit is defined by the control circuit being connected to an interconnection between a fifth resistor and the serial and/or parallel light emitting diodes. Via the fifth resistor, the information can be easily derived, such as for example a magnitude of the current and/or a starting or finishing point in time of the current flowing through the light emitting diode circuit, for controlling the current limiting circuit, such as for example an adaptation of the reduced value of the current flowing through the bleeder circuit and/or an activation or deactivation of the current limiting circuit and/or the circuitry.

According to an embodiment, the bleeder circuit is defined by the control circuit further being connected to an interconnection between two or more of the serial and/or parallel light emitting diodes for further controlling at least a part of the light emitting diode circuit. This control may for example comprise short circuiting one or more light emitting diodes of a serial string during a time interval to reduce a minimum threshold voltage value of the serial string. The other light emitting diodes of this serial string can then draw current for a longer time, and the bleeder circuit can then function for a shorter time, which reduces the power consumption of the bleeder circuit.

According to an embodiment, the bleeder circuit is defined by the active circuitry comprising a dimmer detecting circuit for activating or deactivating the bleeder circuit in response to a detection result. Preferably, such a detecting circuit can also distinguish between several types of dimmers and can select different values of a bleeder current for different time intervals. Depending on the kind of dimmer (so called "leading edge" or "trailing edge" dimmers) it can also be useful to deactivate the bleeder circuit for a part of a cycle, e.g. have a current only for a first part of a voltage half-period. This way, the power consumption of the bleeder circuit is further reduced, which is nowadays important and constitutes a great advantage.

According to a second aspect of the invention, a light emitting diode circuit is provided comprising the bleeder circuit as defined above.

According to a third aspect of the invention, a phase cutting dimmer is provided comprising the bleeder circuit as defined above.

According to a fourth aspect of the invention, a device is provided comprising the bleeder circuit as defined above and further comprising a light emitting diode circuit and/or a phase cutting dimmer and/or a stabilization load for a phase cutting dimmer.

Embodiments of the light emitting diode circuit and of the phase cutting dimmer and of the device correspond with the embodiments of the bleeder circuit.

An insight might be that a passive element offers relatively few options. A basic idea might be that an active element offers relatively many options, that a current limiting circuit is to be used for limiting a current flowing through the bleeder circuit, and that a control circuit is to be used for using information derived from a current flowing through the light emitting diode circuit for controlling the current limiting circuit.

The problem of providing an improved bleeder circuit for a combination of a phase cutting dimmer and a light emitting diode circuit, which bleeder circuit offers relatively many options, has been solved. Further advantages are a reduced power consumption of the bleeder circuit, and easily realizable embodiments that are simple and low cost and efficient.

These and other aspects of the invention are apparent from and will be elucidated with reference to the embodiment(s) described hereinafter.

DETAILED DESCRIPTION OF EMBODIMENTS

Figure 1:
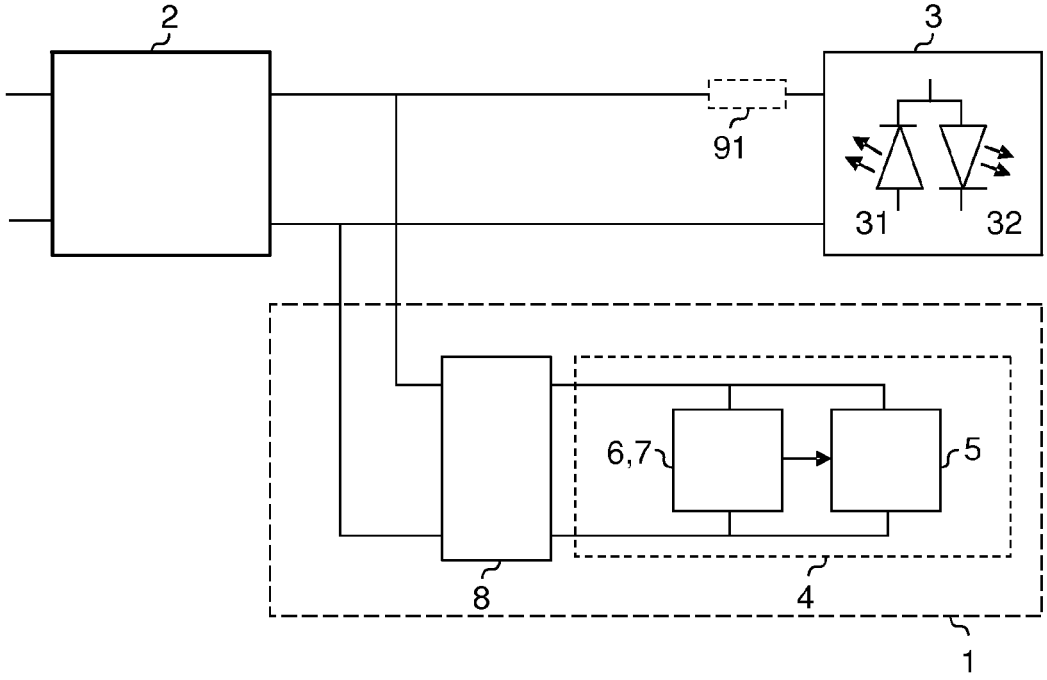
FIG. 1 shows a phase cutting dimmer, a bleeder circuit and a light emitting diode circuit in a first configuration.

In FIG. 1, a phase cutting dimmer 2, a bleeder circuit 1 and a light emitting diode circuit 3 are shown in a first configuration. Two input terminals of the phase cutting dimmer 2 are to be coupled to a (mains) supply not shown, and two output terminals of the phase cutting dimmer 2 are coupled to two input terminals of the bleeder circuit 1 and to two input terminals of the light emitting diode circuit 3, possibly via an optional resistor 91. In this first configuration, the light emitting diode circuit 3 comprises for example anti-parallel light emitting diodes 31 and 32.

Further light emitting diodes and other combinations of light emitting diodes are not to be excluded. The optional resistor 91 may alternatively form part of the light emitting diode circuit 3. In FIG. 1, the phase cutting dimmer 2 is shown as a block that interrupts two wires. In a minimum situation, a phase cutting dimmer may only interrupt one of the wires, without needing the other one. In a more extended situation, a phase cutting dimmer may interrupt one of the wires and use information from the other one, or may interrupt both wires etc.

The bleeder circuit 1 comprises a rectifier 8 having two input terminals that form the two input terminals of the bleeder circuit 1 and having two output terminals coupled to two input terminals of active circuitry 4. This active circuitry 4 comprises a parallel connection of a current limiting circuit 5 for limiting a current flowing through the bleeder circuit 4 and a voltage detecting circuit 6 for activating or deactivating the current limiting circuit 5 in response to a detection result. Alternatively, the voltage detecting circuit 6 may be replaced by control circuitry such as a micro processor circuit 7 for controlling the current limiting circuit 5. An output of the voltage detecting circuit 6 is coupled to an input of the current limiting circuit 5.

Figure 2:
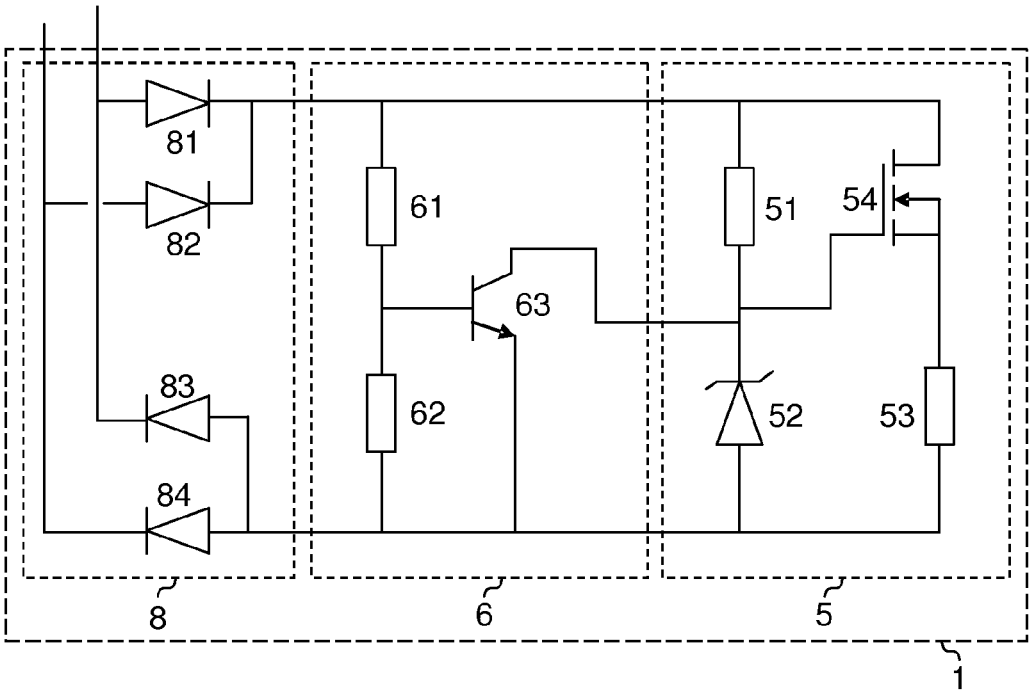
FIG. 2 shows a first embodiment of the bleeder circuit.

In FIG. 2, a first embodiment of the bleeder circuit 1 is shown in greater detail. The rectifier 8 comprises four diodes 81-84 in a diode bridge. Alternatively one or two diodes may be used. The current limiting circuit 5 comprises a parallel connection of first and second serial connections. The first serial connection comprises a first resistor 51 and a voltage reference element 52 such as a zener diode, and the second serial connection comprises a second resistor 53 and an active element such as a transistor 54. A control electrode of the transistor 54 is connected to an interconnection between the first resistor 51 and the voltage reference element 52.

The voltage detecting circuit 6 comprises a third serial connection of third and fourth resistors 61 and 62 and comprises a further active element such as a transistor 63. A control electrode of the further transistor 63 is connected to an interconnection between the third and fourth resistors 61 and 62, and a main electrode of the further transistor 63 is connected to an input of the current limiting circuit 5.

This input is for example the interconnection between the first resistor 51 and the voltage reference element 52. Active elements other than the transistors 54 and 63 are not to be excluded. When use is made of the micro processor circuit 7, an input of it may be connected to an output of the current limiting circuit 5. This output is for example an interconnection between the second resistor 53 and the transistor 54.

The elements 51-54 form a current source that, above a voltage threshold level at the output terminals of the rectifier 8, is de-activated by the elements 61-63.

The control circuitry, such as the micro processor circuit 7, allows even more intelligent detection and control by analyzing a bleeder current (a voltage at or across the resistor 53) and a shape of an applied input voltage. Via a voltage signature the micro processor circuit 7 can distinguish between a leading edge and a trailing edge and can detect the presence of a dimmer. If no dimmer is present, the bleeder circuit 1 can remain off, thus avoiding additional consumption. Leading edge dimmers, which usually use a triac, require a maximal bleeder current. The actually applied current can be measured at or across the resistor 53 during a time interval when the voltage is lowest. Then the micro processor circuit 7 can adjust the limiting current to a value just above that level and thus minimize the bleeder consumption for a particular dimmer.

Figure 3:
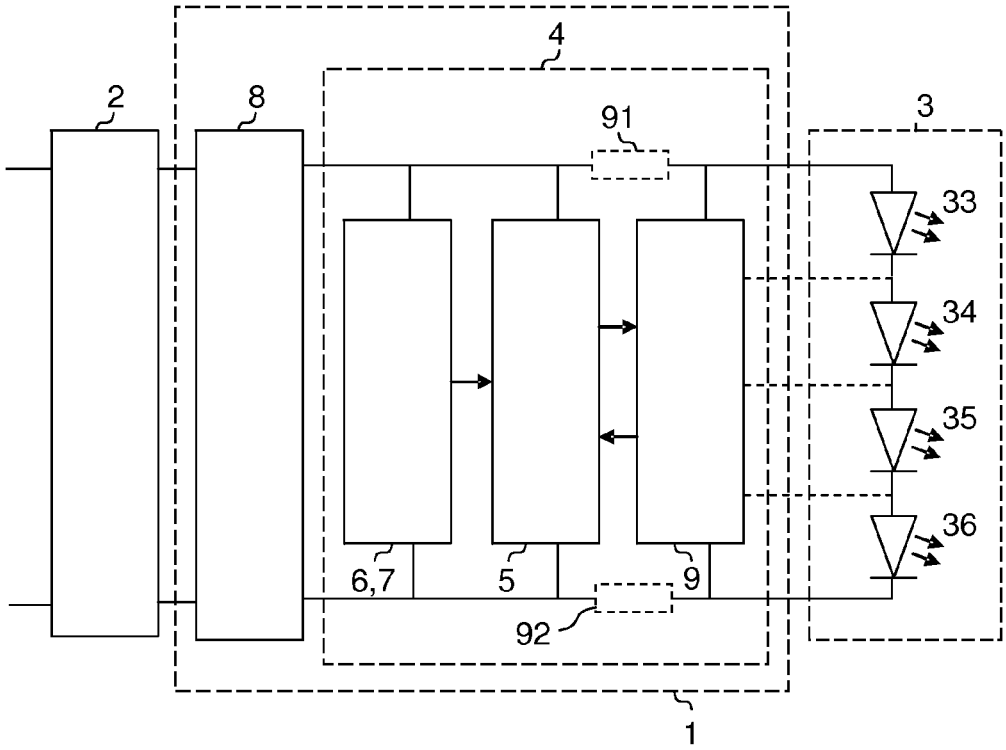
FIG. 3 shows a phase cutting dimmer, a bleeder circuit and a light emitting diode circuit in a second configuration.

In FIG. 3, a phase cutting dimmer 2, a bleeder circuit 1 and a light emitting diode circuit 3 are shown in a second configuration. Two input terminals of the phase cutting dimmer 2 are to be coupled to a (mains) supply not shown, and two output terminals of the phase cutting dimmer 2 are coupled to two input terminals of the bleeder circuit 1. The bleeder circuit 1 comprises a rectifier 8 having two input terminals that form the two input terminals of the bleeder circuit 1 and having two output terminals coupled to two input terminals of active circuitry 4. This active circuitry 4 comprises a parallel connection of a current limiting circuit 5 for limiting a current flowing through the bleeder circuit 4 and a voltage detecting circuit 6 for activating or deactivating the current limiting circuit 5 in response to a detection result. Alternatively, the voltage detecting circuit 6 may be replaced by control circuitry such as a micro processor circuit 7 for controlling the current limiting circuit 5.

The active circuitry 4 further possibly comprises two optional resistors 91 and 92 for coupling the input terminals of the active circuitry 4 to output terminals thereof. The active circuitry 4 may further comprise a control circuit 9 for example coupled to the output terminals of the active circuitry 4 and having an output for example coupled to an input of the current limiting circuit 5 and having an input for example coupled to an output of the current limiting circuit 5. The control circuit 9 uses information derived from a current flowing through the light emitting diode circuit 3 for controlling the current limiting circuit 5. An output of the voltage detecting circuit 6 is coupled to the input of the current limiting circuit 5. In this second configuration, the light emitting diode circuit 3 comprises for example a serial string of light emitting diodes 33-36.

Further light emitting diodes and other combinations of light emitting diodes are not to be excluded. The optional resistors 91 and 92 may alternatively form part of the light emitting diode circuit 3.

Figure 4:
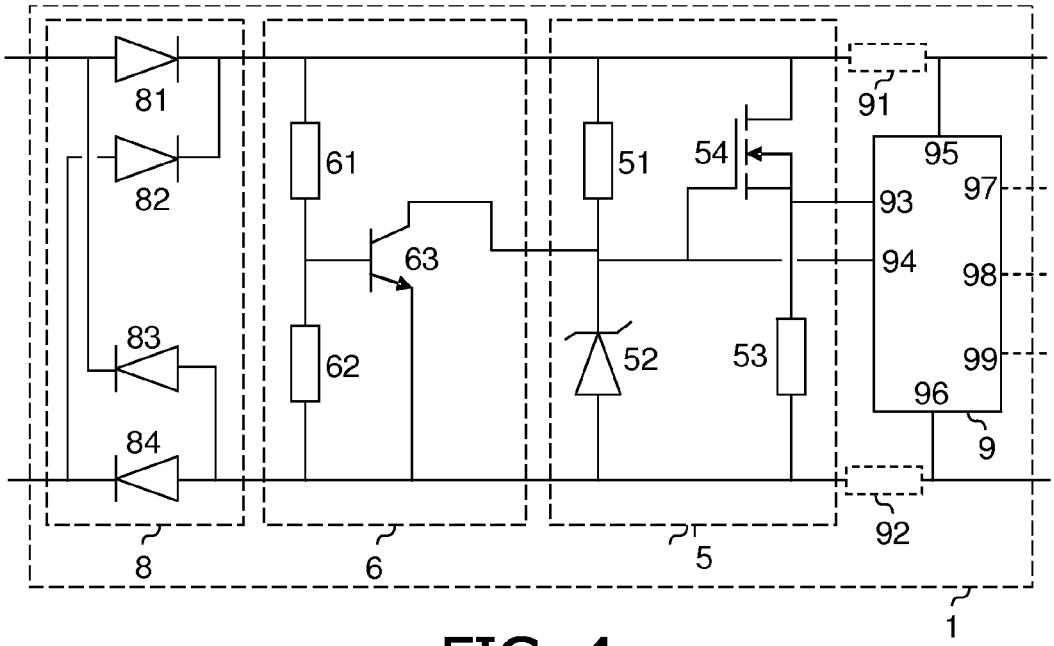
FIG. 4 shows a second embodiment of the bleeder circuit.

In FIG. 4, a second embodiment of the bleeder circuit 1 is shown in greater detail. The rectifier 8 comprises four diodes 81-84 in a diode bridge. Alternatively one or two diodes may be used. The current limiting circuit 5 comprises a parallel connection of first and second serial connections. The first serial connection comprises a first resistor 51 and a voltage reference element 52 such as a zener diode, and the second serial connection comprises a second resistor 53 and an active element such as a transistor 54. A control electrode of the transistor 54 is connected to an interconnection between the first resistor 51 and the voltage reference element 52.

The voltage detecting circuit 6 comprises a third serial connection of third and fourth resistors 61 and 62 and comprises a further active element such as a transistor 63. A control electrode of the further transistor 63 is connected to an interconnection between the third and fourth resistors 61 and 62, and a main electrode of the further transistor 63 is connected to an input of the current limiting circuit 5.

This input is for example the interconnection between the first resistor 51 and the voltage reference element 52. Active elements other than the transistors 54 and 63 are not to be excluded.

The control circuit 9 has terminals 95 and 96 for example coupled to the output terminals of the active circuitry 4 and has an output terminal 94 for example coupled to an input of the current limiting circuit 5 and has an input terminal 93 for example coupled to an output of the current limiting circuit 5. The control circuit 9 uses information derived from a current flowing through the light emitting diode circuit 3 for controlling the current limiting circuit 5. This output is for example an interconnection between the second resistor 53 and the transistor 54. For example a voltage at or across a resistor 91 or 92 may be an indication of a magnitude of a current flowing through the light emitting diode circuit 3. The control circuit 9 may further have respective terminals 97 and 98 and 99 coupled to interconnections between the respective light emitting diodes 33-34 and 34-35 and 35-36 for further controlling at least a part of the serial string.

Figure 5:
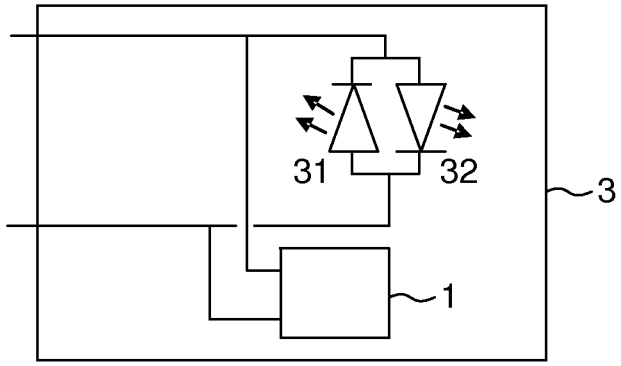
FIG. 5 shows a first embodiment of a light emitting diode circuit comprising a bleeder circuit.

In FIG. 5, a first embodiment of a light emitting diode circuit 3 comprising a bleeder circuit 1 is shown. Here the light emitting diode circuit 3 comprises one or more pairs of anti-parallel light emitting diodes 31-32.

Figure 6:
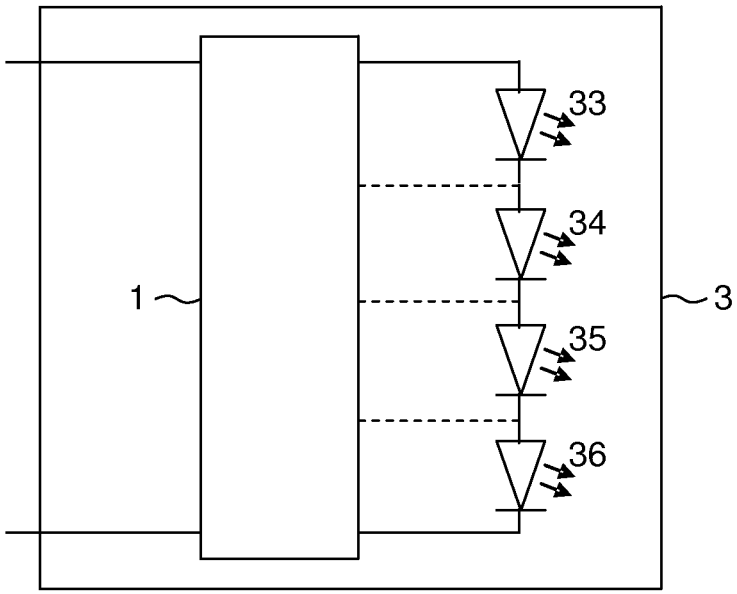
FIG. 6 shows a second embodiment of a light emitting diode circuit comprising a bleeder circuit.

In FIG. 6, a second embodiment of a light emitting diode circuit 3 comprising a bleeder circuit 1 is shown. Here the light emitting diode circuit 3 comprises one or more serial strings of light emitting diodes 33-36.

Figure 7:
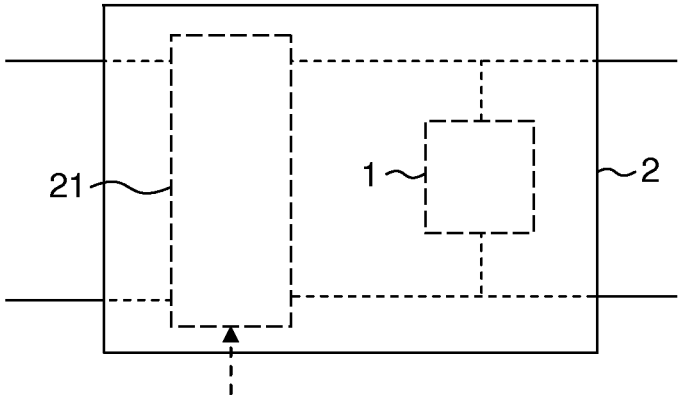
FIG. 7 shows a phase cutting dimmer comprising a bleeder circuit.

In FIG. 7, a phase cutting dimmer 2 comprising a bleeder circuit 1 is shown. The phase cutting dimmer 2 further comprises a dimming circuit 21 such as for example a triac circuit. In FIG. 7, the dimming circuit 21 is shown as a block that interrupts two wires. In a minimum situation, a dimmer circuit may only interrupt one of the wires, without needing the other one. In a more extended situation, a dimming circuit may interrupt one of the wires and use information from the other one, or may interrupt both wires etc.

Figure 8:
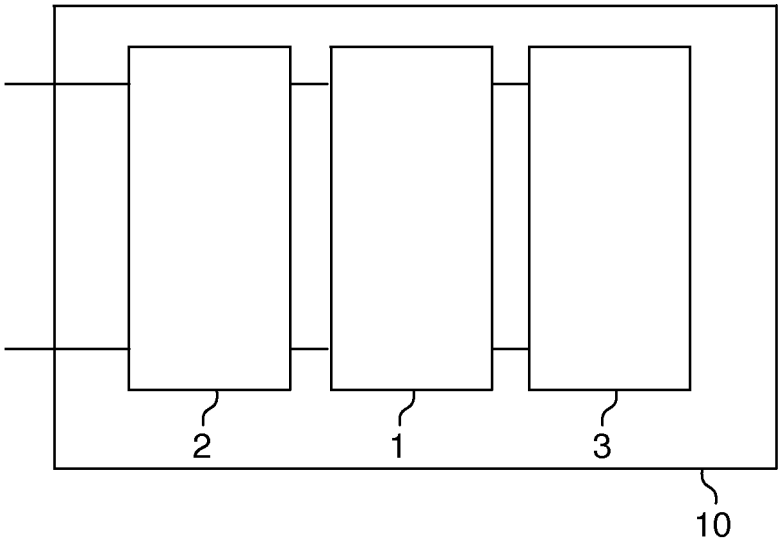
FIG. 8 shows a device comprising a phase cutting dimmer, a bleeder circuit and a light emitting diode circuit.

In FIG. 8, a device 10 comprising a phase cutting dimmer 2, a bleeder circuit 1 and a light emitting diode circuit 3 is shown. In a minimal situation, the device 10 comprises the bleeder circuit 1; in a more extended situation the phase cutting dimmer 2 and/or the light emitting diode circuit 3 and/or a stabilization load for a phase cutting dimmer may be present as well. Said bleeder circuit 1 may form part of such a stabilization load.

The control circuit 9 may further be connected to ground and may alternatively be realized via the voltage detecting circuit 6 or via the control circuitry such as the micro processor circuit 7.

Preferably, by providing the active circuitry 4 with a dimmer detecting circuit, such as a detector for detecting one or more phase cuts, in response to a detection result the entire bleeder circuit 1 can be activated or deactivated, for example for a time interval, wherein for example once per time interval or shortly after the end of a time interval another detection could be made. Such a detector may be implemented via the control circuitry such as the micro processor circuit 7.

The invention precludes the disadvantage that a light emitting diode circuit or LED circuit, when connected to a standard dimmer, may suffer from extreme flicker. More in particular, the nominal power of the light emitting diode circuit is already much lower than the minimum required power by the dimmer to work properly, and should even be reduced further. Most dimmers require some current return path at all times, but e.g. AC-LEDs are only conductive above a certain threshold voltage. Below that threshold voltage there is no current flowing through the load. Triac based dimmers require a minimal current for the Triac to stay conductive, and e.g. small retrofit LED lights only draw a current that is already below that level. Many dimmers, when switched off, still result in a visible light output and show an increased standby consumption.

Additional advantages of the invention could be an integrated own power supply (no additional auxiliary voltage supply is required, the bleeder circuit starts operating close to zero input voltage, and the bleeder circuit stays active while the lamp is off), a self limiting peak current (no spikes in mains current, being intrinsically self protected, and the bleeder circuit consumption is minimal compared to a resistive solution), automatic deactivation at a high voltage (no increase in peak mains current, improved mains total harmonic distortion, and a minimal power consumption), and optionally an adaptive control of bleeder circuit operation (adjust peak current to requirements with a further reduced power loss and increased dimmer compatibility, and activate the bleeder circuit only when really required, with no power losses when no dimmer is connected/used, and otherwise a 50% reduction in power losses being possible).

Triac-based dimmers require an increased bleeder current because of the behavior of the triac itself. By adding detection means the current level of the current source can be adapted depending on the detected requirements. Another interesting point is that depending on the kind of dimmer, only the first or last half of each half-cycle needs to activate the bleeder circuit. Thus, detection means can deactivate the current source for about half the time, when a dimmer is used. If there is more than one light connected to one dimmer, the requirements of the bleeder current per light decrease. The detection means can be enabled to detect this and reduce the current setting accordingly to reduce power losses. Finally, if there is no dimmer used, the power consumption can be minimized by complete deactivation of the bleeder circuit.

Summarizing, bleeder circuits 1 for combinations of phase cutting dimmers 2 and light emitting diode circuits 3 comprise active circuitry 4 to increase the number of options. The active circuitry 4 may comprise a current limiting circuit 5 for limiting a current flowing through the bleeder circuit 1. The active circuitry 4 may comprise a voltage detecting circuit 6 for activating or deactivating the current limiting circuit 5 in response to a detection result, and may comprise control circuitry such as a micro processor circuit 7 for controlling the current limiting circuit 5, and may comprise a control circuit 9 for using information derived from a current flowing through the light emitting diode circuit 3 for controlling the current limiting circuit 5 and for controlling at least a part of the light emitting diode circuit 3 that comprises anti-parallel light emitting diodes 31-32 or serial and/or parallel light emitting diodes 33-36.

While the invention has been illustrated and described in detail in the drawings and foregoing description, such illustration and description are to be considered illustrative or exemplary and not restrictive; the invention is not limited to the disclosed embodiments. For example, it is possible to operate the invention in an embodiment wherein different parts of the different disclosed embodiments are combined into a new embodiment.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

The invention claimed is:

1. A bleeder circuit for a combination of a phase cutting dimmer and a light emitting diode circuit, the bleeder circuit comprising active circuitry, the active circuitry comprising a current limiting circuit for limiting a current flowing through the bleeder circuit, and a control circuit for controlling the current limiting circuit based on information derived from a current flowing through the light emitting diode circuit, wherein the current limiting circuit comprises a parallel connection of first and second serial connections, the first serial connection comprising a first resistor and a voltage reference element, the second serial connection comprising a second resistor and a transistor, a control electrode of the transistor being connected to an interconnection between the first resistor and the voltage reference element.

2. The bleeder circuit as defined in claim 1, wherein the control circuit is connected to an input and an output of the current limiting circuit.

3. The bleeder circuit as defined in claim 2, wherein the interconnection being the input of the current limiting circuit, a further interconnection between the second resistor and the transistor being the output of the current limiting circuit.

4. The bleeder circuit as defined in claim 1, wherein the active circuitry further comprises a voltage detecting circuit for in response to a detection result activating or deactivating the current limiting circuit.

5. The bleeder circuit as defined in claim 4, wherein the voltage detecting circuit comprises a third serial connection of third and fourth resistors and comprising a further transistor, a control electrode of the further transistor being connected to an interconnection between the third and fourth resistors, and a main electrode of the further transistor being connected to an input of the current limiting circuit.

6. The bleeder circuit as defined in claim 1, wherein the active circuitry further comprises a micro processor circuit for controlling the current limiting circuit.

7. The bleeder circuit as defined in claim 1, wherein the information derived from the current flowing through the light emitting diode circuit comprises a size of this current and/or a starting or finishing point in time of this current, said controlling of the current limiting circuit comprising an adaptation of a reduced value of the current flowing through the bleeder circuit and/or an activation or deactivation of the current limiting circuit and/or the active circuitry.

8. The bleeder circuit as defined in claim 1, wherein the light emitting diode circuit comprises anti-parallel light emitting diodes, the bleeder circuit further comprising a rectifier for converting a first voltage into a second voltage, the first voltage being an AC voltage for feeding the light emitting diode circuit, and the second voltage being a DC voltage for feeding the active circuitry.

9. The bleeder circuit as defined in claim 1, wherein the light emitting diode circuit comprises serial and/or parallel light emitting diodes, the bleeder circuit further comprising a rectifier for converting a first voltage into a second voltage, the first voltage being an AC voltage, and the second voltage being a DC voltage for feeding the light emitting diode circuit and the active circuitry.

10. The bleeder circuit as defined in claim 9, wherein the control circuit is connected to an interconnection between a fifth resistor and the serial and/or parallel light emitting diodes.

11. The bleeder circuit as defined in claim 10, wherein the control circuit is further connected to an interconnection between two or more of the serial and/or parallel light emitting diodes for further controlling at least a part of the light emitting diode circuit.

12. The bleeder circuit as defined in claim 1, wherein the active circuitry further comprises a dimmer detecting circuit for in response to a detection result activating or deactivating the bleeder circuit.

13. A light emitting diode circuit comprising the bleeder circuit as defined in claim 1.

14. A phase cutting dimmer comprising the bleeder circuit as defined in claim 1.

15. A device comprising the bleeder circuit as defined in claim 1 and further comprising a light emitting diode circuit and/or a phase cutting dimmer and/or a stabilization load for a phase cutting dimmer.

* * * * *